US005148723A

United States Patent [19]

Newman, Sr. et al.

[11] Patent Number: 5,148,723

[45] Date of Patent: Sep. 22, 1992

[54] LIGHT BULB CHANGER

[76] Inventors: Robert D. Newman, Sr.; Robert D. Newman, Jr., both of P.O. Box 247, Greenwood, Mo. 64034

[21] Appl. No.: 653,044

[22] Filed: Feb. 11, 1991

[51] Int. Cl.[5] ..... H01K 3/32

[52] U.S. Cl. ..... 81/53.11

[58] Field of Search ..... 81/53.11

[56] References Cited

U.S. PATENT DOCUMENTS

| | | | |
|---|---|---|---|
| 1,541,839 | 6/1925 | Metzler et al. | 81/53.11 |
| 2,545,043 | 3/1951 | Odenthal | 81/53.11 |
| 2,634,998 | 4/1953 | Flower | 81/53.11 |
| 2,637,587 | 5/1953 | Robinson | 81/53.11 |

*Primary Examiner*—James G. Smith

*Attorney, Agent, or Firm*—Hovey, Williams, Timmons & Collins

[57] ABSTRACT

An apparatus useful for changing light bulbs includes a suction cup for forming a suction attachment by way of a partial vacuum between the cup and a smooth surface when the cup is pressed against the surface wherein the suction cup includes structure defining at least one aperture. A sealing device for sealing the aperture is provided, the sealing device includes structure for selectively releasing the seal from the aperture in order to relieve the partial vacuum thereby allowing detachment of the apparatus from the surface.

3 Claims, 1 Drawing Sheet

Fig. 1.
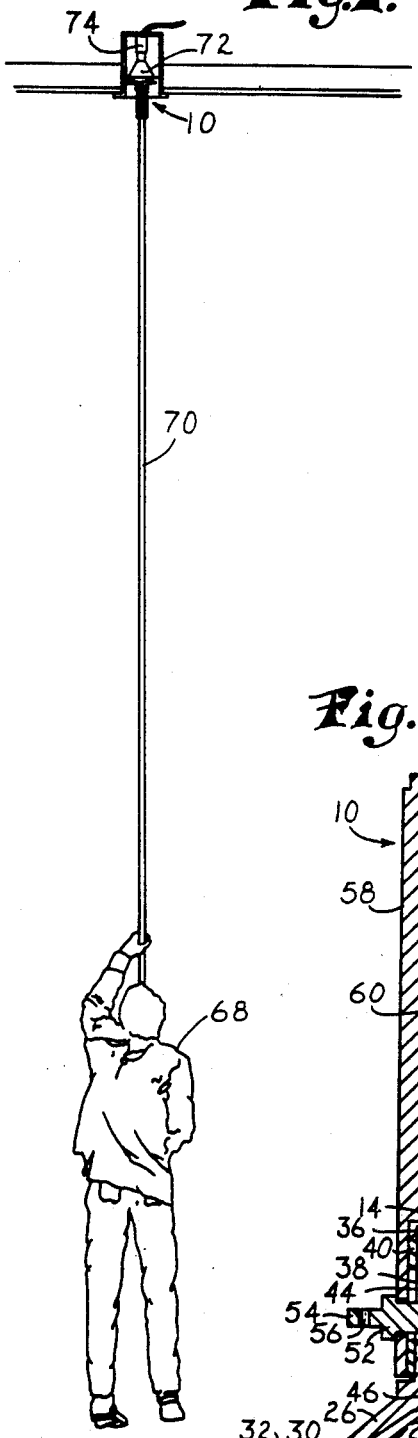
Fig. 2.
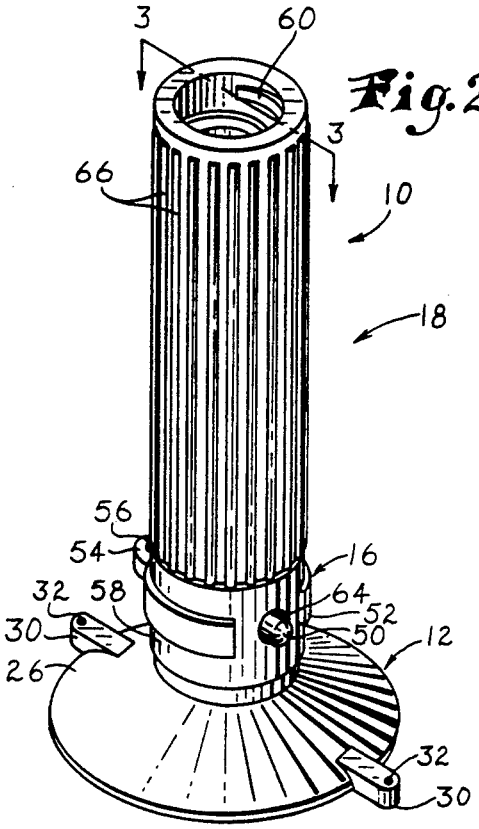
Fig. 3.
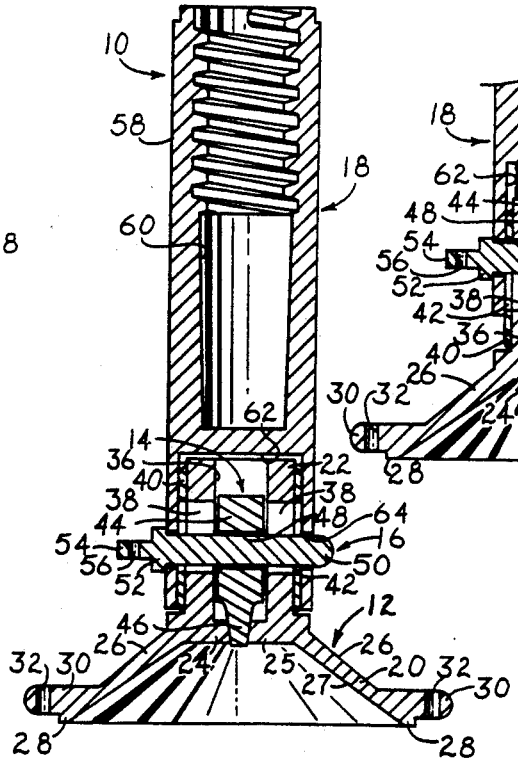
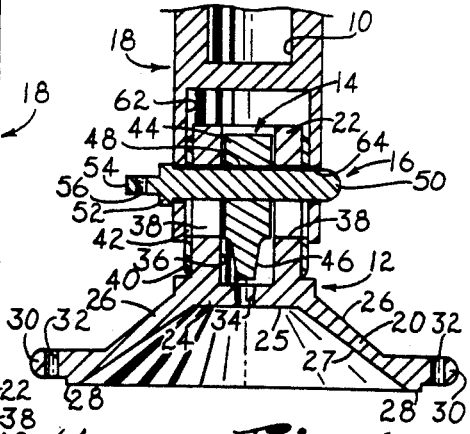
Fig. 4.

LIGHT BULB CHANGER

BACKGROUND OF THE INVENTION

1. Field of the Invention

This invention relates to a suction attachment device for use in changing light bulbs in ceilings, for example. More particularly, it is concerned with a suction attachment device with at least one aperture which is releasably sealed to enable and disable the suction attachment.

2. Description of the Prior Art

The use of suction attachment devices in changing light bulbs is well known. These devices typically use a pliable suction cup attached to an extension pole to enable an operator to change a light bulb in a location such as a ceiling which is out of reach of the operator. To release the suction attachment, one approach has been to connect an ear to the outside of the suction cup and to thread a string through a hole in the ear so that when the operator pulls on the string, a portion of the cup is pulled away from the light bulb to release the device from the light bulb.

These prior art devices present a problem in that the operator must maintain control over the device and the string at the same time. When the device is used at an angle the string may hang out of the reach of the operator. Also, string fatigue can result in the string breaking which leaves the device attached to the bulb with no easy way of releasing the suction.

SUMMARY OF THE INVENTION

The problems outlined above are solved by the light bulb changer in accordance with the present invention. That is to say, the light bulb changer hereof includes a suction releasing means which is integral to the changer and is especially designed to reduce the posibility of the suction release means breaking.

In accordance with the invention, the preferred light bulb changer includes suction means for forming a suction attachment between the changer and a smooth surface when the apparatus is pressed against the surface. The suction means includes structure defining at least one aperture and sealing means the sealing for aperture. The sealing means includes releasing means for releasing the seal from the aperture so that the suction attachment is removed.

BRIEF DESCRIPTION OF THE DRAWING

FIG. 1 is a view illustrating an operator using a light bulb changer in accordance with the present invention with an extension rod attached thereto.

FIG. 2 is a perspective view of the preferred light bulb changer in accordance with the present invention.

FIG. 3 is a vertical section view of the light bulb changer taken along line 3—3 of FIG. 2 and illustrates the internal construction of the light bulb changer in an aperture sealed position.

FIG. 4 is a partial sectional view of the changer shown in a suction releasing position.

DESCRIPTION OF THE PREFERRED EMBODIMENT

Referring now to the drawing figures, a light bulb changer 10 in accordance with the invention broadly includes a suction cup 12, a sealing pin 14, a coupling pin 16 and a handle 18. Sealing pin 14 and handle 18 are slidably attached to suction cup 12 with coupling pin 16 (see FIG. 3).

In more detail, suction cup 12 (preferably formed of Geon flexible vinyl, commercially available from B. F. Goodrich Inc., part no. 86312-65A) includes a generally frustoconical member 20, a substantially cylindrical member 22 and a base section 24. Frustoconical member 20, presents an outside surface 26, an inside surface 27 and a rim 28. A pair of opposed ears 30 are attached to outside surface 26 adjacent to rim 28. Ears 30 include holes 32 defined therethrough at right angles to rim 28.

As shown in FIG. 4, base 24, presenting an outside face 25, is parallel to rim 28 and includes a frustoconically shaped aperture 34 with the narrower inlet opening being adjacent face 25, an opposed, wider outlet opening, and a frustoconical sidewall interconnecting the inlet and outlet openings. Cylindrical member 22 is attached perpendicular to base 24 and includes a bore 36 which extends the length of member 22, and includes a pair of opposed oblong slots 28 perpendicular to bore 36. A reinforcing collar 40 (preferably formed of ABS) is attached around member 22 and includes slots 42 which align with the slots 38.

Sealing pin 14, preferably formed of polypropylene, includes a generally cylindrical body 44 and a frustoconical tip 46, the latter presenting a frustoconical sidewall complemental with the sidewall of aperture 34. Sealing pin 14 is slidably received within bore 36 with tip 46 facing toward base 24. Body 44 includes a perpendicularly defined hole 48 aligned with slots 38 and 42.

As best seen in FIG. 2, coupling pin 16, preferably formed of polyproplene, includes a generally cylindrical member 50, an arcuate member 52 and an ear 54. Cylindrical member 50 presents two opposing ends, one of which is attached to the center of arcuate member 52 so that the other end of member 50 is between the ends of arcuate member 52. Ear 54 includes hole 56 defined therethrough and is attached to the opposite side of arcuate member 52 from cylindrical member 50 so that ear 54 is in line with cylindrical member 50.

Handle 18, preferably formed of polypropylene, presents a generally cylindrical shape and an outer surface 58. A partially threaded bore 60 is defined in one end of handle 18, and a bore 62 is defined in the other end of handle 18. Handle 18 also includes a pair of opposed holes 64 defined therethrough which pass through that portion of handle 18 with bore 62. Finally, a series of parallel, spaced apart, ribs 66 are attached to outer surface 58 to enhance the gripping of handle 18 by an operator.

To assemble light bulb changer 10 sealing pin 14 is placed within bore 36 with the tip 46 toward base 24 so that hole 48 aligns with slots 38 and 42. Next, suction cup 12 is slipped within bore 62 and holes 64 are aligned with slots 42 thereby effectively forming a single aperture through handle 18, collar 40, cup 12 and pin 14. Cylindrical member 50 is then passed through this single aperture. In so doing, arcuate member 52 is forced around outer surface 58. In this way, arcuate member 52 retains cylindrical member 50 on changer 10.

In use, an operator 68 normally threads an extension rod 70 onto light bulb changer 10 within bore 60 (see FIG. 1). Operator 68 then presses suction cup 12 against a light bulb 72 which, in turn, forces sealing pin tip 46 through aperture 34, so that the pin sidewall sealingly engages the sidewall of aperture 34. The soft and pliable construction of suction cup 12 relative to tip 46 allows aperture 34 to expand and conform to tip 46.

With aperture 34 effectively sealed by pin 14 a partial vacuum is formed between inside surface 27 and light bulb 72 when operator 68 presses light bulb changer 10 against light bulb 72. Operator 68 then turns handle 70 to attach or detach light bulb 72 to a socket 74. After light bulb 72 has been inserted or removed, light bulb changer 10 is pulled away from bulb 72 thus pulling tip 46 out of aperture 34 to create a passageway between the aperture and pin sidewalls and thus relieve the partial vacuum.

Another way of releasing the partial vacuum is provided by the use of one of ears 30, ear 54 and a length of string (not shown). A knot sufficiently large to prevent its passage through the hole 32 is tied in one end of the string, and the other end is threaded through hole 32 of ear 30 on the same side of changer 10 as ear 54. Next, the string is threaded through hole 56 until the knot prevents further movement of the string. After a partial vacuum has been achieved and operator 68 wishes to release the attachment, he may then pull on the string which pulls rim 28 away from bulb 72 and releases the partial vacuum. Obviously, the string must be sufficiently long to be within easy reach of operator 68.

As those skilled in the art will appreciate, substitutions may be made for the preferred embodiment and equivalents employed herein without departing from the scope of the present invention as recited in the claims. For example, a plurality of apertures and pins to seal them could be used. Also, sealing pin 14 could be attached to the handle directly and thereby eliminate the need for coupling pin 16.

Having thus described the preferred embodiment of the present invention, the following is claimed as new and desired to be secured by Letters Patent:

1. Apparatus useful for changing a light bulb, comprising:

a generally cup-shaped member presenting a central base and an outwardly extending, light bulb-engaging sidewall formed of pliant, resilient material, said base having structure defining an aperture therethrough, including an aperture inlet, an opposed aperture outlet, and a sidewall interconnecting said inlet and outlet;

an elongated sealing pin configured for selective insertion into and sealing of said base aperture in order to prevent passage of air through the base aperture, said sealing pin including a sidewall for sealingly engaging said aperture sidewall;

means mounting said pin on said member for selective axial shifting movement of the pin between a sealing position wherein the pin is inserted within said base aperture with the pin sidewall sealingly engaging the aperture sidewall to prevent passage of air through the aperture, and an open position wherein the pin is at least partially withdrawn from the base aperture and a passageway is defined between said pin and aperture sidewalls to permit passage of air through the aperture; and handle means operably coupled with said pin and supporting said member for, when the pin is in the open position thereof, compression of said member sidewall against a light bulb and axial shifting of the pin to the sealing position thereof in order to exhaust air from the member through said aperture and passageway and then seal the aperture, thereby creating a partial vacuum beween the light bulb and said member sidewall and attaching the light bulb to the member, and for subsequent withdrawal of the pin from said aperture in order to permit passage of air through the aperture and passageway to thereby relieve said partial vacuum and detach said member from said light bulb.

2. Apparatus as set forth in claim 1, said aperture sidewall and pin sidewall being of complemental, frustoconical configuration.

3. Apparatus as set forth in claim 1, said bulb-engaging sidewall being formed of vinyl.

* * * * *